US006863912B2

(12) United States Patent
Lin

(10) Patent No.: US 6,863,912 B2
(45) Date of Patent: Mar. 8, 2005

(54) SHRIMP AND SURIMI TRAY

(76) Inventor: Duke Lin, 3450 Fujita St., Torrance, CA (US) 90505

( * ) Notice: Subject to any disclaimer, the term of this patent is extended or adjusted under 35 U.S.C. 154(b) by 206 days.

(21) Appl. No.: 10/233,091

(22) Filed: Aug. 28, 2002

(65) Prior Publication Data

US 2003/0006151 A1 Jan. 9, 2003

Related U.S. Application Data

(63) Continuation-in-part of application No. 09/750,803, filed on Jan. 2, 2001, now Pat. No. 6,514,548.

(51) Int. Cl.[7] ..... B65D 85/00; B65D 61/00; A22C 25/00

(52) U.S. Cl. ..... 426/115; 426/120; 426/124; 426/129; 426/394; 206/541

(58) Field of Search ..... 426/115, 120, 426/124, 129, 394; 206/541

(56) References Cited

U.S. PATENT DOCUMENTS 1,949,285 A * 2/1934 Porter ..... 211/74
D364,090 S 11/1995 Krupa
D394,985 S 6/1998 Curis et al.
D396,606 S 8/1998 Blazevich
5,843,500 A * 12/1998 Guarino ..... 426/91
D404,612 S 1/1999 Blazevich
5,869,120 A 2/1999 Blazevich
D411,709 S 6/1999 Curtis et al.
D420,285 S 2/2000 Sagan et al.
6,021,903 A 2/2000 Hanson
6,022,571 A 2/2000 Blazevich
6,042,856 A 3/2000 Sagan et al.
D422,907 S 4/2000 Sagan et al.
6,168,813 B1 1/2001 Blazevich
2003/0129284 A1 * 7/2003 Leuenberger ..... 426/129

* cited by examiner

*Primary Examiner*—N. Bhat
(74) *Attorney, Agent, or Firm*—Aaron T. Borrowman; Kelly Lowry & Kelley, LLP

(57) ABSTRACT

A circular tray has a sloping surface extending upwardly from a central base to form a circular support ridge. A retaining ridge concentrically surrounds the support ridge. The support ridge is configured to support a plurality of shrimp arranged to form a nearly arched-shaped ring. A sauce cup is removably disposed on the central base adjacent to tails of the arranged shrimp. An outer ridge concentrically surrounds the retaining ridge. A groove formed between the outer and retaining ridges is sized and configured so as to hold a plurality of pieces of surimi.

22 Claims, 2 Drawing Sheets

SHRIMP AND SURIMI TRAY

RELATED APPLICATION

This application is a continuation-in-part of U.S. patent application Ser. No. 09/750,803, filed Jan. 2, 2001, now U.S. Pat. No. 6,514,548.

BACKGROUND OF THE INVENTION

The present invention generally relates to food packaging, such as shrimp trays. More particularly, the present invention relates to a shipping and serving tray for both shrimp and surimi.

Trays are presently used for packaging and serving frozen shrimp. However, these trays typically require shrimp to be placed on their sides in multiple layers. One consequence is that the overlapping, layered shrimp can be difficult to remove individually from the tray. Each shrimp must be pried from the adjacent shrimp. Subsequent consumers cannot be assured that remaining shrimp have not been handled.

A second undesirable characteristic of prior art tray and shrimp combinations of this type is an uneven top surface. The combination of the tray with layered tapered shrimp forms an irregular upper surface. There is only a small center of the tray that can serve as a base for stacking similar trays with shrimp. Stacking and storing multiple trays of shrimp could, therefore, be unstable and difficult.

Another undesirable characteristic of some prior art products is a lack of structural support. The weight of the vertically stacked shrimp is predominantly placed on a tiered, horizontal surface that is raised above the base of the tray. The weight of the shrimp on this surface can deform or damage the tray. The inclined horizontal surface provides limited support when a radially inward force is applied by a wrapping or sealing process, as well as when trays are stacked upon one another.

Another disadvantage of prior shrimp trays is that the shrimp trays are designed to only accommodate shrimp. Often times, frozen fish, such as surimi, is served with the frozen shrimp.

Accordingly, there is need for a shrimp, surimi and tray combination that can be stacked and stored, has vertical and horizontal support, is free from the risk of damage, and facilitates convenient, visually appealing service. The present invention fulfills these needs and provides other related advantages.

SUMMARY OF THE INVENTION

The present invention is embodied in a novel shrimp, surimi and tray combination for use in and serving shrimp and surimi. The combination is designed to allow convenient, visually appealing service of shrimp and surimi. Additionally, the resulting configuration of shrimp with the tray creates a strong unit that allows for stable and convenient stacking and storage.

The shrimp and surimi tray of the present invention comprises a generally circular tray formed from a single sheet of plastic. A central, circular base, includes a sloping surface extending upwardly from a peripheral edge thereof to form a circular support ridge. A retaining ridge concentrically surrounds the support ridge, to form a first groove between the support ridge and the retaining ridge. An outer ridge concentrically surrounds the retaining ridge, forming a second groove between the outer and retaining ridges. Typically, the retaining and outer ridges are of approximately the same height, and the support ridge is of a greater height than the retaining and outer ridges. In a particularly preferred embodiment, the central base, first groove and second grooves are generally coplanar.

A plurality of shrimp are arranged radially such that each shrimp's inner concave side is positioned over the support ridge so that a plurality of shrimp are arranged in a single layer, the convex side of the plurality of the shrimp forming a nearly arched-shaped ring. A sauce cup is removably disposed on the central base within the tails of the shrimp.

A plurality of pieces of surimi are positioned in the second groove, generally end to end or in a staggered formation to form a ring-like arrangement. The groove is sized and configured such so as to hold two ring-like arrangements.

For added support, a flat insert, such as cardboard, is attached to a bottom surface of the central base, first groove and second groove. Wrapping film, such as shrink-wrap or vacuum sealed plastic, covers the tray, sauce cup, shrimp and surimi for transportation and storage purposes.

One advantageous feature is the radial arrangement of shrimp around the inner ridge. The bodies of the shrimp can form a level, annular surface. The head and tail of each shrimp can rest on the bottom of the tray and abut the wall of either the tray or the cup. The shrimp thus conform to the tray and create a partially flat surface on which trays may be securely stacked. The frozen shrimp form an annular arch and thus provide a strong, supporting surface. This arrangement in combination with the arranged surimi, also creates a visually appealing display from which the shrimp or surimi may be individually removed without difficulty.

Other features and advantages of the present invention will become apparent from the following detailed description of the preferred embodiment, taken in conjunction with the accompanying drawings, which illustrate by way of example the principles of the invention.

BRIEF DESCRIPTION OF THE DRAWINGS

The accompanying drawings illustrate the invention. In such drawings.

DETAILED DESCRIPTION OF THE PREFERRED EMBODIMENT

As shown in the accompanying drawings for purposes of illustration, the present invention resides in a tray, generally referred to by the reference number 10, for use in packaging, shipping, storing and serving frozen shrimp and fish, particularly surimi. The tray 10 is preferably thermoformed from a single sheet of suitable plastic, and as will be more fully described herein, comprises a plurality of seamlessly joined annular, concentric and circular surfaces. The tray 10 should be made of sufficiently rigid plastic so as to support the shrimp and surimi, as well as being stackable upon one another for storing and transporting purposes.

Figure 1:
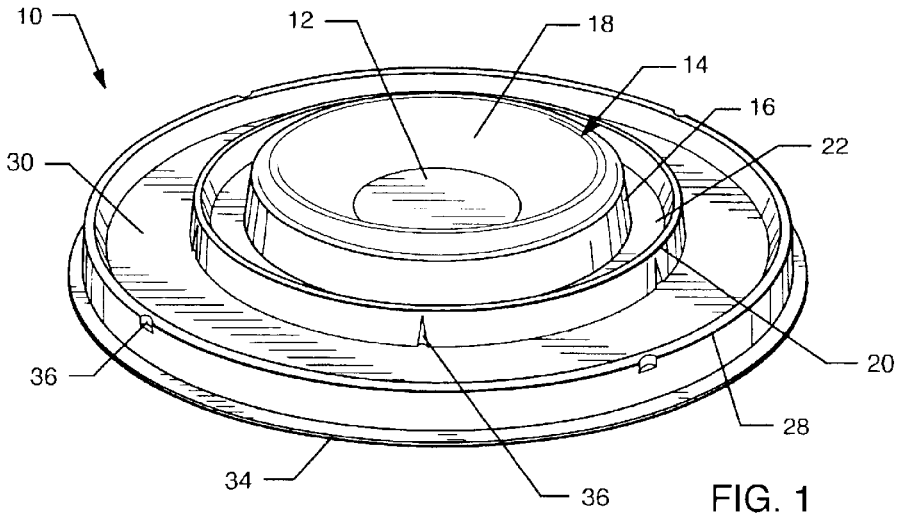
FIG. 1 is a perspective view of a shrimp and surimi tray embodying the present invention.
Figure 2:
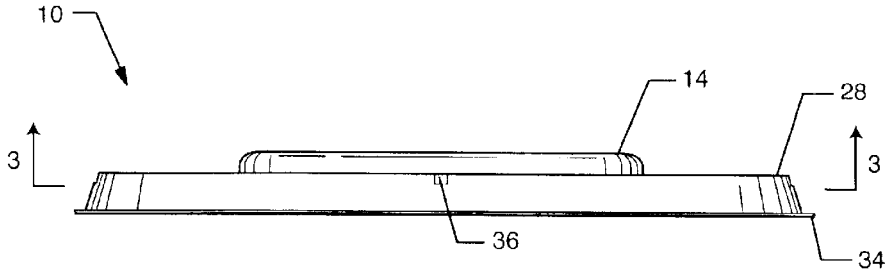
FIG. 2 is a side elevational view of the tray.
Figure 3:
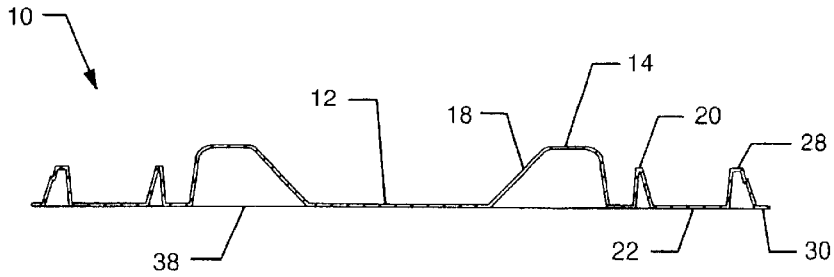
FIG. 3 is a cross-sectional view taken generally along line 3—3 of FIG. 2.

Referring now primarily to FIGS. 1–3, the tray 10 is of a generally circular configuration. A center portion of the tray 10 comprises a generally flat central base 12. A rounded support ridge 14 concentrically encircles the base 12 and includes a raised annular wall 16 and a sloped, typically smooth, surface 18 that extends downwardly at an appropriate angle towards the central base 12 of the tray 10. The support ridge 14 extends from the top of the nearly vertical raised wall 16 and merges with the sloped surface 18. The sloped surface 18, although preferably smooth, can be either straight or curved in cross-section to accommodate the shape and size of the particular shrimp to be used with the tray 10.

A retaining ridge 20 is formed in the plastic as a concentric ring spaced from the support ridge 14. Typically, the retaining ridge 20 is shorter in height than the support ridge 14. The retaining ridge 20 can be defined by vertical or slightly sloped walls. An annular bottom surface 22 extends inward from the retaining ridge 20 to the outer wall 16 of the support ridge 14 to define a first groove.

Figure 4:
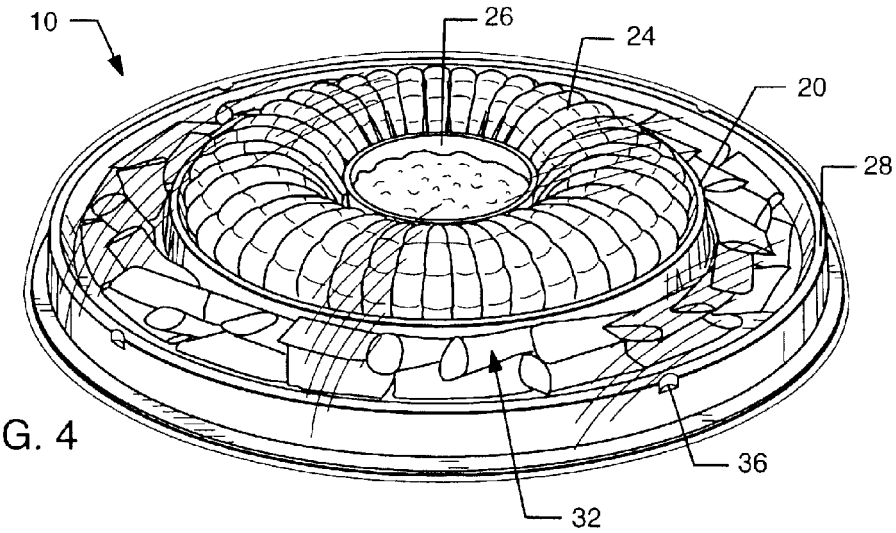
FIG. 4 is a perspective view of a sealed and assembled tray having a sauce cup, and shrimp and surimi arranged thereon.
Figure 5:
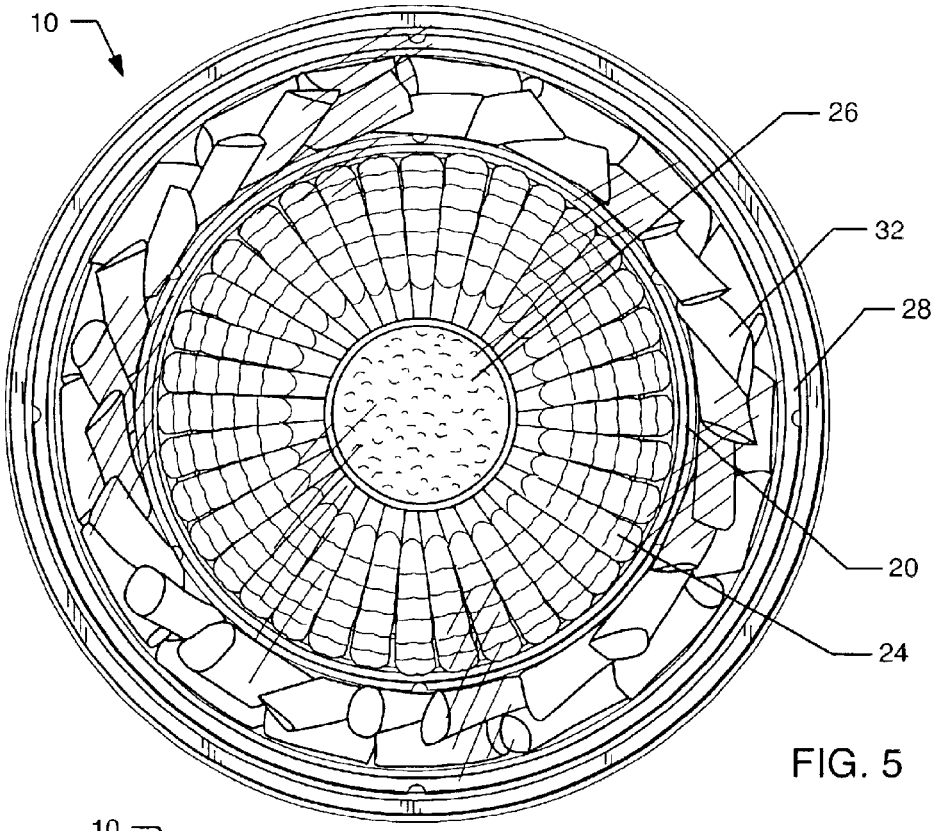
FIG. 5 is a top plan view of the assembled tray of FIG. 4.
Figure 6:
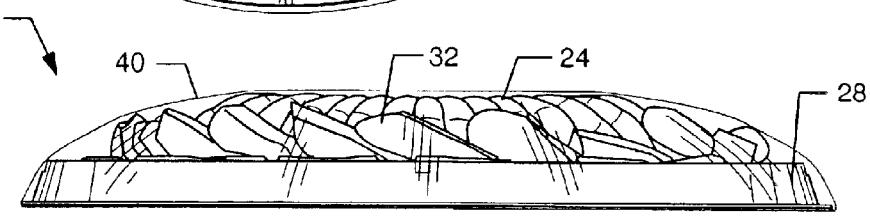
FIG. 6 is a side elevational view of the assembled tray.

With reference now to FIGS. 4–6, when shrimp 24 are placed on the tray 10, the annular support ridge 14 serves as a retainer for the shrimp 24, with the sloped surface 18 providing a support surface for the shrimp 24. A plurality of the shrimp 24 are frozen and arranged radially, tails inward towards the central base 12, on top of the tray with the concave side of each shrimp 24 resting on top of the support ridge 14. The arch of each shrimp 24 is supported by the sloped surface 18 and support ridge 14. The wider heads of the shrimp 24 are disposed adjacent to the first groove 22, abutting the inner wall of the retaining ridge 20. The retaining ridge 20 acts as a retainer preventing excessive movement of the shrimp 24 in a direction radially outward from the center of the tray 10. Radial movement of the shrimp is thus restrained or prevented. The optimum radial width of the tray 10 and the radial width of each of the annular surfaces varies depending on the size of the shrimp 24 intended for use of the tray 10. A representative tray 10 may hold 36–44 medium-sized frozen shrimp.

Referring now particularly to FIGS. 4 and 5, a sauce cup 26 is removably disposed over the central base 12. The sauce cup 26 may be a rigid plastic cup, and lid, and placed at the center of the tray 10 where it resides in the depression formed by the sloping surfaces 18 and the disc-like central base 12. When so assembled, the tail of each shrimp 24 abuts the cup 26 located at the center of the tray 10. With the head of each shrimp 24 between the inner wall of the retaining ridge 20 and the tail of each shrimp 24 butting the cup 26, the annular surfaces of the tray 10 and cup 26 interact with the shrimp 24 to oppose any radially inward force applied to the tray 10. Such radially inward or compression forces can, for example, be encountered in a shrink wrap, or other sealing process, or during packaging or shipping. The strength thus provided reduces the risk of damage or deformation of the product.

Referring again to FIGS. 1–3, an outer ridge 28 is formed as a concentric ring spaced from the retaining ridge 20 in towards the periphery of the tray 10. The outer ridge 28 typically has a similar configuration as the retaining ridge 20. The retaining ridge 20 and outer ridge 28 are typically approximately the same height, and the outer ridge 28 is defined by inner and outer walls which are vertical or slightly sloped.

An annular bottom surface extends inward from the inner wall of the outer ridge 28 defining the bottom of a second groove 30. This groove 30 is of a substantially larger diameter or radial width than the first groove 22 so as to accommodate frozen fish.

With reference again to FIGS. 4–6 in a particularly preferred embodiment, the frozen fish comprises surimi 32. Although the surimi 32 may be arranged in a number of manners, in the illustrated preferred embodiment, the surimi 32 is placed in the second groove 30 at an end to end, or staggered, relationship, to form a generally circular or ring-like arrangement. It has been found that a relatively large number of surimi 32 can be disposed in the second groove 30 with this arrangement, and that this arrangement is aesthetically pleasing, particularly when viewed with the arched ring-like arrangement of the shrimp 24. As illustrated, the surimi 32 even when arranged in a double-ring formation as illustrated, lie below the upper surface of the ring of shrimp 24.

Referring again to FIGS. 1–3, an outer, circular flange 34 may extend from the outer wall of the outer ridge 28. Preferably, notches 36 are formed in the retaining ridge 20 and outer ridge 28, or as needed on the tray 10 to facilitate the grasping of the tray 10 by automated machinery during the packaging process.

It will be noted that the support ridge 14, retaining ridge 20, and outer ridge 28 are concentric to one another. The central base 12, first groove 22, and second groove 30 are generally planar with one another and flat. This flat bottom surface of the tray 10 acts to distribute the load over a supporting surface below (not shown). The generally flat bottom surface of the tray 10 also allows trays 10, in their assembled form, to be stacked upon one another. When frozen, the shrimp 24 can be a primary source of vertical support. Because they are frozen, the shrimp 24 form an arched, annular surface, that is primarily supported by the flat surface and center of the tray 10. Therefore, it is not necessary that the support ridge 14 be extremely thick or strong. When the shrimp 24 are radially arranged on the tray 10, as described herein, the annular shrimp surface formed by the outside of the shrimp bodies is substantially ordinarily level, and slightly raised from the cup 26. These extended, substantially flat support surfaces provide strength and stability when the trays 10 having shrimp 24 and surimi 32 are stacked upon one another.

With particular reference to FIG. 3, a flat and rigid insert 38 may be attached to the co-planar surfaces of the tray 10 to provide additional support. This flat and circular base insert 38 may be made of heavy paper or cardboard and can have consumer information and labeling printed thereon. However, it should be understood that the base insert 38 can be omitted as the annular flat surfaces of the central base 12, first groove, second groove 30 and outer flange 34 are all substantially or nearly level with one another, these elements bearing against the base insert 38 or supporting horizontal surface when the tray 10 is stacked or otherwise subject to vertical load.

The cup 26 can be filled with sauce for dipping the shrimp 24 and surimi 32 and the tray 10, cup 26, shrimp 24 and surimi 32 can be assembled, and covered with a wrapping film 40 and frozen together. Although the wrapping film 40 is illustrated in FIG. 6 as being rather loose with respect to the tray 10, shrimp 24 and surimi 32, preferably, the wrapping film 40 is shrink-wrapped or vacuum-sealed onto these elements to form a tight fit. This provides a firm annular surface on which multiple trays can be stacked, as described above.

When the assembled tray 10 is thawed and unwrapped for serving, the shrimp 24 are easily accessible to a consumer. The shrimp 24 are arranged radially in a single layer, thus each individual shrimp 24 can be easily removed without disturbing the remaining shrimp 24. Similarly, the surimi 32 can be individually removed from one another without disturbing the remaining surimi 32. Additionally, the annular arched arrangement of the shrimp 24 and the staggered ring-like arrangement of the surimi 32 provides a visually appealing presentation for service.

Although an embodiment has been described in detail for purposes of illustration, various modifications may be made without departing from the scope and spirit of the invention. Thus, the invention is not to be limited, except by the appended claims.

What is claimed is:

1. A shrimp and surimi tray, comprising:

a central base, a sloping surface extending upwardly from a peripheral edge of the central base and forming a circular support ridge configured to support a plurality of shrimp positioned so that concave sides of the shrimp fit over and engage the support ridge, a retaining ridge concentrically surrounding the support ridge, a first groove between the support ridge and the retaining ridge, an outer ridge concentrically surrounding the retaining ridge, and a second groove between the outer and retaining ridges configured to hold a plurality of surimi pieces therein.

2. The shrimp and surimi tray of claim 1, including a sauce cup removably disposed on the central base.

3. The shrimp and surimi tray of claim 1, wherein the tray is generally circular and formed from a single sheet of plastic.

4. The shrimp and surimi tray of claim 1, wherein the retaining and outer ridges are of approximately the same height.

5. The shrimp and surimi tray of claim 1, wherein the support ridge is of a greater height than the retaining and outer ridges.

6. The shrimp and surimi tray of claim 1, wherein the central base, first and second grooves are generally coplanar.

7. The shrimp and surimi tray of claim 6, including a flat insert attached to a bottom surface of the central base, first groove and second groove.

8. The shrimp and surimi tray of claim 1, wherein the sloping surface is generally smooth.

9. The shrimp and surimi tray of claim 2, including a wrapping film covering the tray, sauce cup, shrimp, and surimi.

10. The shrimp and surimi tray of claim 1, wherein each of the plurality of shrimp is arranged radially with its inner concave side positioned over the support ridge so that the plurality of shrimp are arranged in a single layer, the convex side of each of the plurality of shrimp forming a nearly arch-shaped ring.

11. The shrimp and surimi tray of claim 1, wherein the plurality of pieces of surimi are positioned in the second groove to form a generally ring-like arrangement.

12. A shrimp and surimi and tray combination, comprising:

a generally circular tray formed from a single sheet of plastic having a central base, a sloping surface extending upwardly from a peripheral edge of the central base and forming a circular support ridge, a retaining ridge concentrically surrounding the support ridge, a first groove between the support ridge and the retaining ridge, an outer ridge concentrically surrounding the retaining ridge, and a second groove between the outer and retaining ridges;

a sauce cup removably disposed on the central base;

a plurality of shrimp arranged radially such that each shrimp's inner concave side is positioned over the support ridge so that the plurality of shrimp are arranged in a single layer, the convex side of the plurality of shrimp forming a nearly arch-shaped ring; and a plurality of pieces of surimi positioned in the second groove generally end to end to form a ring-like arrangement;

wherein the central base, first and second grooves are generally coplanar.

13. The combination of claim 12, wherein the retaining and outer ridges are of approximately the same height.

14. The combination of claim 13, wherein the support ridge is of a greater height than the retaining and outer ridges.

15. The combination of claim 12, including a flat insert attached to a bottom surface of the central base, first groove and second groove.

16. The combination of claim 12, wherein the sloping surface is generally smooth.

17. The combination of claim 12, including a wrapping film covering the tray, sauce cup, shrimp, and surimi.

18. A shrimp and surimi tray, comprising:

a support ridge, a retaining ridge, and an outer ridge concentrically formed in a single sheet of plastic;

a central base having an outer edge defined by the support ridge;

a first groove extending between the support ridge and the retaining ridge; and a second groove extending between the retaining ridge and the outer ridge;

wherein the support ridge and the retaining ridge are configured to cooperatively support shrimp; and wherein the second groove is sized and configured to support surimi thereon.

19. The tray of claim 18, wherein the retaining and outer ridges are of approximately the same height.

20. The tray of claim 19, wherein the support ridge is of a greater height than the retaining and outer ridges.

21. The tray of claim 18, wherein the central base, first groove and second groove are generally coplanar.

22. The tray of claim 21, including a flat insert attached to a bottom surface of the central base, first groove and second groove.

* * * * *